US007735992B2

(12) United States Patent
Kumagai

(10) Patent No.: US 7,735,992 B2
(45) Date of Patent: Jun. 15, 2010

(54) RECORDING APPARATUS AND LIQUID EJECTING APPARATUS

(75) Inventor: Toshio Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 324 days.

(21) Appl. No.: 12/047,720

(22) Filed: Mar. 13, 2008

(65) Prior Publication Data

US 2008/0225100 A1 Sep. 18, 2008

(30) Foreign Application Priority Data

Mar. 13, 2007 (JP) ..... 2007-064067

(51) Int. Cl.
*B41J 2/01* (2006.01)

(52) U.S. Cl. ..... 347/102; 347/1; 347/16; 347/100

(58) Field of Classification Search ..... 347/1, 347/16, 100–102
See application file for complete search history.

(56) References Cited

U.S. PATENT DOCUMENTS

| | | | | |
|---|---|---|---|---|
| 6,206,508 | B1 * | 3/2001 | Asakawa et al. | 347/65 |
| 2002/0065335 | A1 * | 5/2002 | Noguchi et al. | 522/84 |
| 2004/0189773 | A1 * | 9/2004 | Masumi et al. | 347/102 |
| 2007/0172261 | A1 * | 7/2007 | Raksha et al. | 399/266 |
| 2007/0197685 | A1 * | 8/2007 | Aruga et al. | 523/160 |
| 2009/0290008 | A1 * | 11/2009 | Fukui | 347/104 |

FOREIGN PATENT DOCUMENTS

| | | |
|---|---|---|
| JP | 2001-239660 | 9/2001 |
| JP | 2002-355952 | 12/2002 |
| JP | 2003-145725 | 5/2003 |
| JP | 2004-042548 | 2/2004 |
| JP | 2004-155046 | 6/2004 |
| JP | 2004-516961 | 6/2004 |
| JP | 2004-268549 | 9/2004 |
| JP | 2005-125513 | 5/2005 |
| JP | 2005-153384 | 6/2005 |
| JP | 2005-153507 | 6/2005 |
| JP | 2005-324443 | 11/2005 |
| JP | 2007-118421 | 5/2007 |

* cited by examiner

*Primary Examiner*—Ellen Kim
(74) *Attorney, Agent, or Firm*—Workman Nydegger

(57) ABSTRACT

A recording apparatus includes a support drum which rotates while supporting a recording medium on a support surface thereof. A guide shaft of the recording apparatus is spaced apart from the support surface by a predetermined distance and extends in parallel to a direction perpendicular to a rotation direction of the support drum. A carriage which is guided by the guide shaft is reciprocally moved along the support surface. A recording head mounted on the carriage ejects an ultraviolet curing ink toward the recording medium. An ultraviolet ray irradiation unit irradiates ultraviolet rays to the ultraviolet curing inks which are ejected from the recording head. In operation, the carriage is moved along the guide shaft so as to form an image formed by the ultraviolet curing ink and a coat ink over the overall surface of the recording medium supported by the support drum.

6 Claims, 7 Drawing Sheets

RECORDING APPARATUS AND LIQUID EJECTING APPARATUS

BACKGROUND

1. Technical Field

The present invention relates to a recording apparatus and a liquid ejecting apparatus and more particularly to a recording apparatus and a liquid ejecting apparatus using an ultraviolet curing ink.

2. Related Art

There is provided a recording apparatus or a liquid ejecting apparatus for forming an image or a pattern on a recording medium using an ultraviolet curing ink. The ultraviolet curing ink has preferred characteristics that the ultraviolet curing ink is slowly cured before ultraviolet rays are irradiated and is rapidly cured when the ultraviolet rays are irradiated, as a print ink. Since a solvent is not volatilized at the time of curing, an environment load is small.

The ultraviolet curing ink has excellent characteristics that an adhesion property is high with respect to various recoding mediums due to composition of vehicle, the ink becomes chemically stable after curing, an adhesion property, chemical resistance, weatherability, and friction resistance are high, and the ink is bearable in the outdoor environment. Accordingly, instead of a recording medium having a thin sheet shape, such as paper, a resin film or a metal foil, an image can be formed on a medium having a stereoscopic surface shape, such as a label surface of an optical recording medium or a textile product.

As a method of attaching the ultraviolet curing ink to a recording medium, a coating method or a printing method may be used, but an ink jet recording apparatus which can form any image or pattern with high precision without a printing plate may be used. By a combination of main scan for moving a recording head for ejecting an ink and sub scan for moving the recording medium in a direction crossing a main scan direction, an image can be recorded in any area with respect to a long or wide recording medium using a nozzle having a restricted dimension.

In JP-A-2004-155046, an ink jet recording apparatus for irradiating an ink including an ultraviolet curing agent onto a recording surface immediately after recording so as to improve a quick drying property of the recording surface is described. In more detail, in the ink jet printer, the ultraviolet curing ink is used as the ink and the ink attached to the recording medium is immediately cured and fixed by ultraviolet lamps provided at the both ends of the main scan direction of the recording head.

In JP-A-2005-324443 and JP-A-2005-125513, an image forming apparatus which includes recording heads for ejecting an ink cured by irradiating ultraviolet rays and an ultraviolet ray irradiation unit connected to the recording heads and relatively moves an image support, the recording head and the ultraviolet ray irradiation unit is described. In the image forming apparatus described herein, an input digital image is formed on the image support by scan of the plurality of recording heads and the ink is individually cured by irradiating the ultraviolet rays for each scan. In JP-A-2004-042548, ultraviolet rays are individually irradiated for each color in a recording apparatus for ejecting ultraviolet curing inks having different colors from nozzles so as to perform color printing.

However, when the image is formed using the ultraviolet curing ink, the image may be recorded on the recording medium having translucency, such as a resin film, using the high adhesion property. In this case, for the purpose of suppressing influence on the color tone of the image of the light passing through the medium, the image may be formed after an undercoat layer is formed by a coat ink having a high hiding property over an area in which the image is formed on the recording medium. The overcoat layer may be formed by covering the surface of the image formed on the recording medium with the transparent coat ink such that the image is protected and the surface of the area in which the image is formed smoothens.

With respect to the transparent recording medium, an image may be formed from a rear surface so as to be visible through the recording medium. In this case, for the purpose of maintaining the color tone of the image and cover the rear surface of the image, a back coat layer may be formed by covering the rear surface of the image formed on the recording medium with an ink having a higher hiding property.

The ink for coating may include a large amount of pigment for the purpose of increasing the hiding property or may not include the pigment in order to ensure transparency. That is, the ink for coating has properties different from those of many color inks in chemical properties or optical properties. Accordingly, in the case where the ink is coated by the ink jet method, the nozzle specification is different and the wavelength and the irradiation amount of the ultraviolet rays irradiated for curing is different. Accordingly, in the case of forming the image having the coat layer, the image is formed by two recording processes using the recording apparatus which individually includes a coat ink recording unit and an image recording unit.

However, in the above-described structure, the scale of the recording apparatus is increased and the throughput of a recording operation is increased. Since the printing sequences of the case of forming the undercoat layer and the case of forming the overcoat layer or the back coat layer are inverse, the operation of the recording apparatus is troublesome. Even when both the undercoat layer and the overcoat layer are formed, the operation sequence is further increased. Accordingly, the cost of a product including various types of coat layers is increased.

SUMMARY

According to a first aspect of the invention, there is provided a recording apparatus including: a support drum which rotates while supporting a recording medium on a support surface thereof; a guide shaft which is spaced apart from the support surface by a predetermined distance and extends in parallel to a direction perpendicular to a rotation direction of the support drum; a carriage which is guided by the guide shaft and is reciprocally moved along the support surface; a recording head which is mounted on the carriage and ejects an ultraviolet curing ink toward the recording medium supported by the support surface; a coat head which is mounted on the carriage, is provided at least one side of the recording head in a reciprocal movement direction of the carriage, and ejects an ultraviolet curing coat ink forming at least one of an undercoat layer formed on the recording medium and an overcoat layer superimposed on an ink layer adhered to a surface of the recording medium; and an ultraviolet ray irradiation unit which irradiates ultraviolet rays to the ultraviolet curing inks which are ejected from the recording head and the coat head and are adhered to the recording medium; and wherein, whenever the support drum is rotated at least one revolution, the carriage is moved along the guide shaft so as to form an image formed by the ultraviolet curing ink and the coat ink over the overall surface of the recording medium supported by the support drum. Accordingly, since the recording head and the coat head can be transported by one carriage so as to form the image including the coat layer, it is possible to suppress the scale of the apparatus.

In the recording apparatus, the carriage may be moved in a direction in which the coat head precedes the recording head, when the undercoat layer is formed, and may be moved in a direction in which the recording head precedes the coat head, when the overcoat layer is formed. Accordingly, since the image and the coat layer can be continuously formed by moving the carriage relative to the recording medium one time, the throughput of the recording operation can be improved.

In the recording apparatus, when the overcoat layer is formed, the irradiation amount of the ultraviolet rays irradiated from the ultraviolet ray irradiation unit to the coat ink may be lower than that when the undercoat layer is formed. Accordingly, since the surface of the overcoat layer formed on an uppermost surface of the image smoothens, it is possible to form an image with high quality.

In the recording apparatus, a plurality of ultraviolet ray irradiation units may be arranged at the downstream side of the rotation direction of the support drum, with respect to the recording head and the coat head. Accordingly, with respect to the recording head and the coat head, it is possible to form the ultraviolet ray irradiation unit for irradiating the ultraviolet rays under the individual conditions suitable for the inks ejected from the heads. Thus, it is possible to suppress the stripping of the layers due to excessive curing, sufficiently cure the inks, and form an image with high quality.

In the recording apparatus, the coat ink ejected from the coat head may be any one of a white ink and a transparent ink. Accordingly, the white coat layer is formed on the surface of a transparent or colored recording medium or the surface of the image formed on a transparent recording medium so as to improve the color of the image. In addition, since the surface of the image formed on the recording medium is covered with the transparent coat layer, the image can be protected and the surface of the image can smoothen.

According to a second aspect of the invention, there is provided a liquid ejecting apparatus including: a support drum which rotates while supporting a recording medium on a support surface thereof; a guide shaft which is spaced apart from the support surface by a predetermined distance and extends in parallel to a direction perpendicular to a rotation direction of the support drum; a carriage which is guided by the guide shaft and is reciprocally moved along the support surface; a liquid ejecting head which is transported by the carriage and ejects liquid including an ultraviolet curing component toward the recording medium supported by the support surface; a coat head which is transported by the carriage, is provided at least one of a front side and a back side of the liquid ejecting head in a reciprocal movement direction of the carriage, and ejects an ultraviolet curing coat material forming at least one of an undercoat layer formed on the recording medium and an overcoat layer superimposed on an ink layer adhered to a surface of the recording medium; and an ultraviolet ray irradiation unit which irradiates ultraviolet rays to the liquid and the coat material which are ejected from the liquid ejecting head and the coat head and are adhered to the recording medium; and wherein, whenever the support drum is rotated at least one revolution, the carriage is moved along the guide shaft so as to form a pattern formed by the liquid and the coat material over the overall surface of the recording medium supported by the support drum. Accordingly, even in the liquid ejecting apparatus, the above-described effect can be obtained.

The summary of the invention does not enumerate all features of the invention. A sub-combination of the features may be included in the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Although the embodiments of the invention are described in the following description, the following embodiments do not restrict the invention related to claims. A combination of features described in the embodiments is not necessary for solving the invention.

Embodiment

Figure 1:
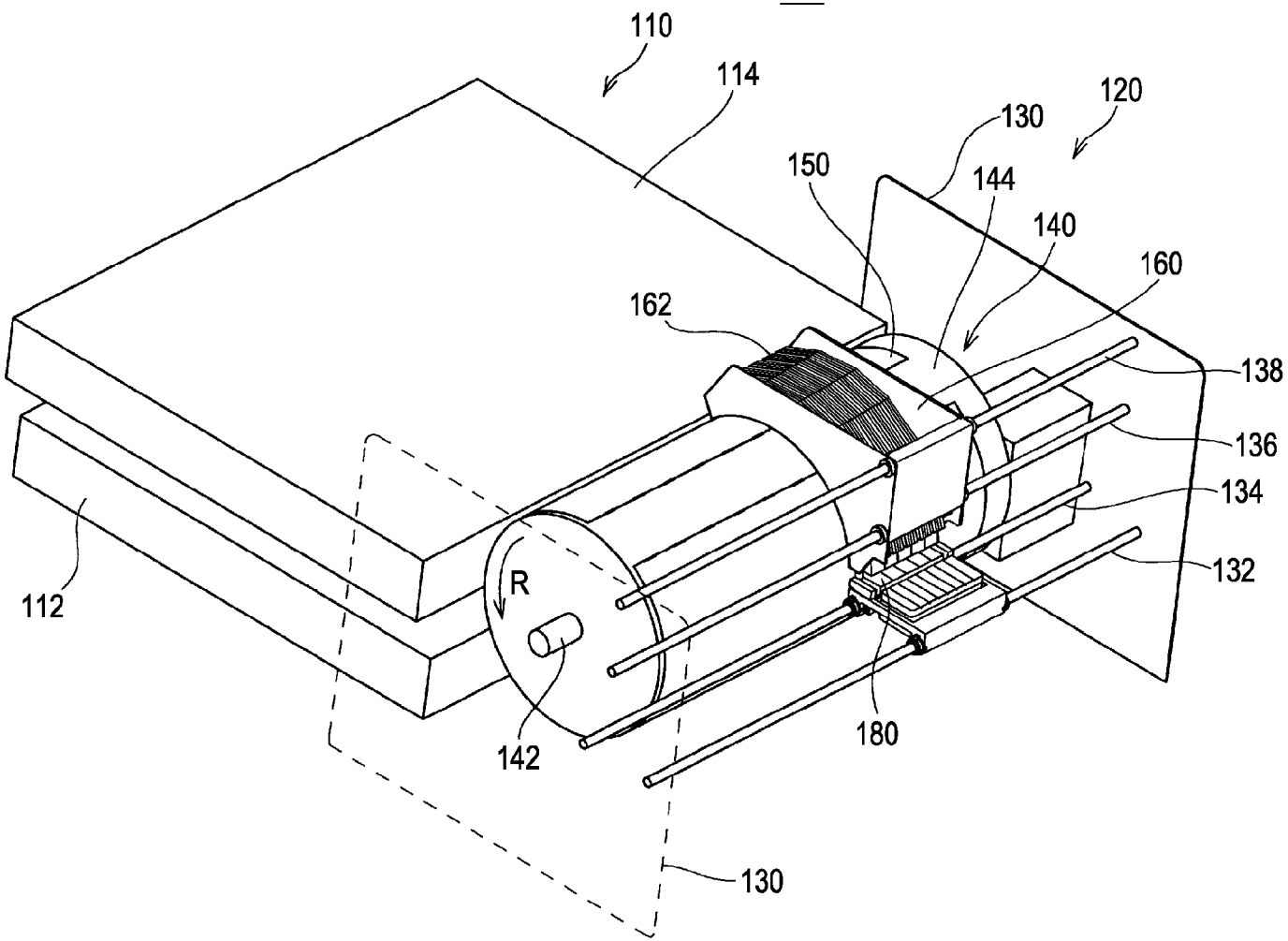
FIG. 1 is a schematic view the overall structure of an ink jet recording apparatus 100 according to an embodiment of the invention.

FIG. 1 is a schematic view the overall structure of an ink jet recording apparatus 100 according to an embodiment of the invention. As shown in FIG. 1, the ink jet recording apparatus includes a recording unit 120 interposed between a pair of erected frames 130, which face each other, and a feeding/ejecting unit 110 including a feeding unit 112 and an ejecting unit 114.

The recording unit 120 includes a support drum 140 and guide shafts 132, 134, 136 and 138, all of which are supported between the pair of parallel frames 130. The support drum 140 is rotated in a direction denoted by an arrow R shown in the drawing in a state in which a rotation shaft 142 is pivoted from the frames 130 and a recording sheet 150 is maintained on a support surface 144. A member for rotating the support drum 140 is not shown.

Meanwhile, among two pairs of parallel guide shafts 132, 134, 136 and 138, a pair of guide shafts 132 and 134 passes through a recording unit carriage 170 and supports the recording unit carriage 170 in a state of being reciprocally moved. The recording unit carriage 170 mounts and transports a recording head 180.

The pair of guide shafts 136 and 138 supports an irradiation unit carriage 160 in a state of being reciprocally moved. The irradiation unit carriage 160 mounts and transports an ultraviolet ray irradiation unit 162. Driving mechanisms for moving the irradiation unit carriage 160 and the recording unit carriage 170 are not shown for the purpose of avoiding complexity of the drawing.

The feeding unit 112 feeds a plurality of recording sheets 150 laminated therein to the recording unit 120 having the above-described structure one by one. The recording sheet 150 fed to the recording unit 120 is wound on the support surface 144 of the support drum 140 and is rotated together with the support drum 140.

The recording head 180 mounted on the recording unit carriage 170 ejects and adheres an ultraviolet curing ink to the recording sheet 150 which is rotated in a state of being supported by the support drum 140. The irradiating ray irradiation unit 162 irradiates ultraviolet rays to the ultraviolet curing ink adhered to the recording sheet 150. Thus, an image formed by the ultraviolet curing ink is fixed on the surface of the recording sheet 150.

If the support drum 140 is rotated one or more revolutions and the image is recorded on the recording sheet 150 in a partial area of a longitudinal direction of the support drum 140, the recording unit carriage 170 is moved along the guide shafts 132 and 134 and the same recording operation is performed with respect to an area adjacent to the above area. Hereinafter, whenever the support drum 140 is rotated one or more revolutions while the recording head 180 performs the recording operation, the recording unit carriage 170 is repeatedly moved so as to form the image on the overall surface of the recording sheet 150.

In other words, in the ink jet recording apparatus 100, the rotation direction of the support drum 140 is a main scan direction and the movement direction of the recording unit carriage 170 is a sub scan direction. This is different from many recording apparatuses in which the movement direction of the carriage is the main scan direction and the transporting direction of the recording sheet 150 is the sub scan direction of the carriage.

The irradiation unit carriage 160 for transporting the ultraviolet ray irradiation unit 162 is moved according to the movement of the recording unit carriage 170 such that the ultraviolet rays are irradiated to the ultraviolet curing ink ejected from the recording head 180 onto the recording sheet 150. Preferably, the movement start timings of the irradiation unit carriage 160 and the recording unit carriage 170 may be slightly different from each other such that the peak of a load for a power source of the ink jet recording apparatus 100 is reduced.

That is, if the irradiation unit carriage 160 and the recording unit carriage 170 are integrally formed, the inertial mass which will be accelerated when the movement of the carriage is started is remarkably increased and thus a load for the driving mechanism is remarkably increased. If the large mass is stably accelerated/decelerated, the frames 130 having a high strength and a large weight are required. Accordingly, the capacity of the power source is decreased by the structure, in which the irradiation unit carriage 160 and the recording unit carriage 170 are separated, so as to decrease the scale and the cost of the apparatus.

The recording sheet 150 on which the image is recorded is stripped from the support drum 140 and is transported and accumulated to the ejecting unit 114. The structures related to the feed/ejection of the feeding unit 112 and the ejecting unit 114 and the winding and the stripping of the recording sheet on/from the support drum 140 are not included in the major point of the invention and thus the detailed description thereof will be omitted.

Figure 2:
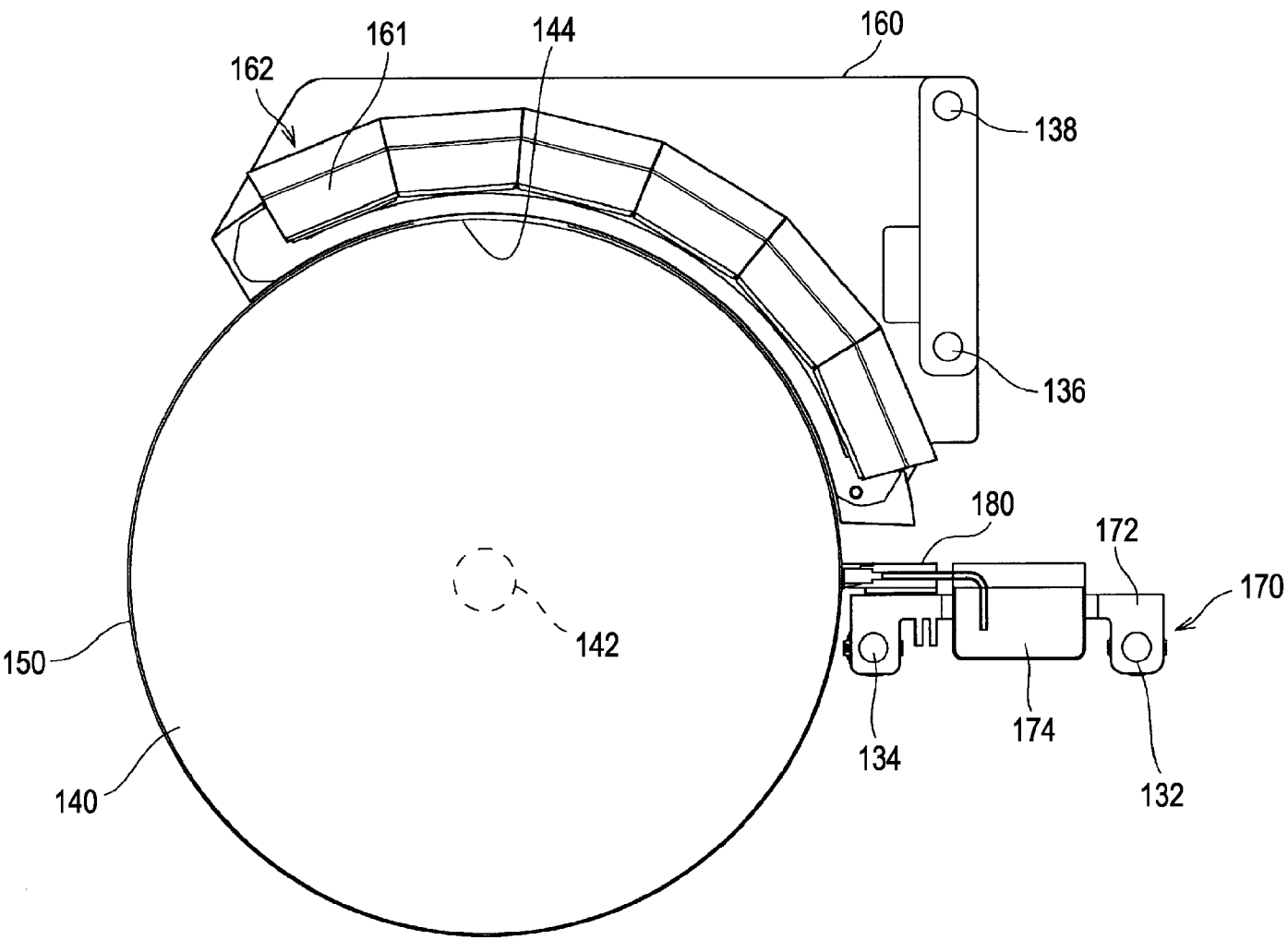
FIG. 2 is a view showing the cross-sectional structure of a recording unit 120 of the ink jet recording apparatus 100.

FIG. 2 is a view showing the cross-sectional structure of the recording unit 120 of the ink jet recording apparatus 100 shown in FIG. 1. As shown in FIG. 2, in the recording unit 120, the recording unit carriage 170 supports the pair of guide shafts 132 and 134, includes an ink tank 174, and supports the recording head 180.

The ink tank 174 contains a predetermined amount of ink fed from an ink cartridge (not shown) and stably feeds a constant amount of ink to the recording head 180. The recording head 180 faces the recording sheet 150 held by the support surface 144 of the support drum 140 and ejects the ink toward the recording sheet 150.

The ultraviolet ray irradiation unit 162 includes a plurality of lamp units 161 arranged in the rotation direction of the support drum 140. Accordingly, the plurality of lamp units 161 are arranged in the rotation/movement direction of the recording sheet 150 which is moved by the rotation of the support drum 140. Thus, even when the output of each of the lamp units 161 is small, a sufficient irradiation amount of ultraviolet rays is obtained while the recording sheet 150 is rotated.

In the recording unit 120, the recording sheet 150 to which the ink ejected from the recording head 180 is adhered is rotated and moved in the direction denoted by the arrow R of the drawing by the rotation of the support drum 140. The ultraviolet ray irradiation unit 162 supported by the irradiation unit carriage 160 is placed at the downstream side of the recording head 180 in the rotation direction. Accordingly, the ultraviolet curing ink which is ejected from the recording head 180 and is adhered to the recording sheet 150 is immediately cured by the irradiation of the ultraviolet rays.

Figure 3:
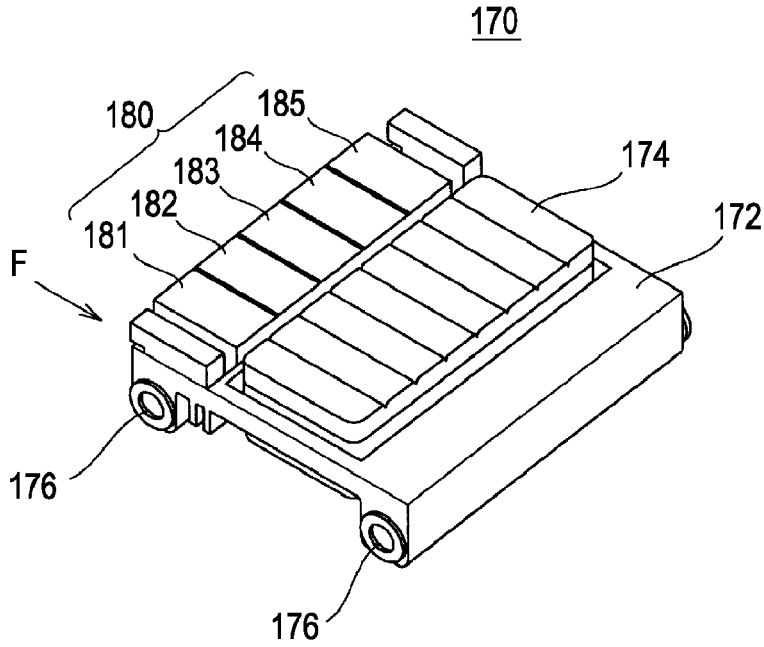
FIG. 3 is a perspective view showing only a recording unit carriage 170.

FIG. 3 is a perspective view showing only the recording unit carriage 170 on which the recording head 180 is mounted. As shown in FIG. 3, the recording unit carriage 170 includes a pair of parallel through-holes 176, through which the guide shafts 132 and 134 pass, and a carriage main body 172 including the ink tank 174. The recording head 180 is mounted on the upper surface of the carriage main body 172. As described below, the recording head 180 includes five head units 181 to 185. The head units 181 to 185 eject different types of inks.

Figure 4:
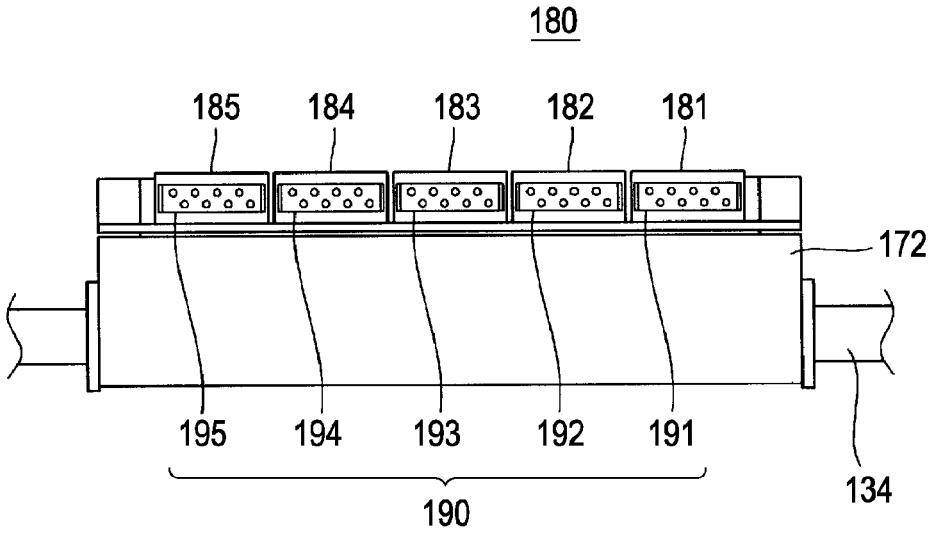
FIG. 4 is a front view showing a recording head 180.

FIG. 4 is a front view showing the recording head 180 when viewed from a direction denoted by an arrow F shown in FIG. 3. As shown in FIG. 4, the recording head 180 includes the five head units 181 to 185. The head units 181 to 185 respectively include nozzle plates 191 to 195 formed on the surface which faces the recording sheet 150 supported by the support drum 140. Nozzles for ejecting the ultraviolet curing inks are formed in the nozzle plates 191 to 195. As the driving structure for ejecting the inks from the head unit 181 to 185, various methods such as a method of sucking ink droplets by electrostatic force and a method of jetting the ink using a piezoelectric element are already known and can be properly selected according to the use thereof.

Figure 5:
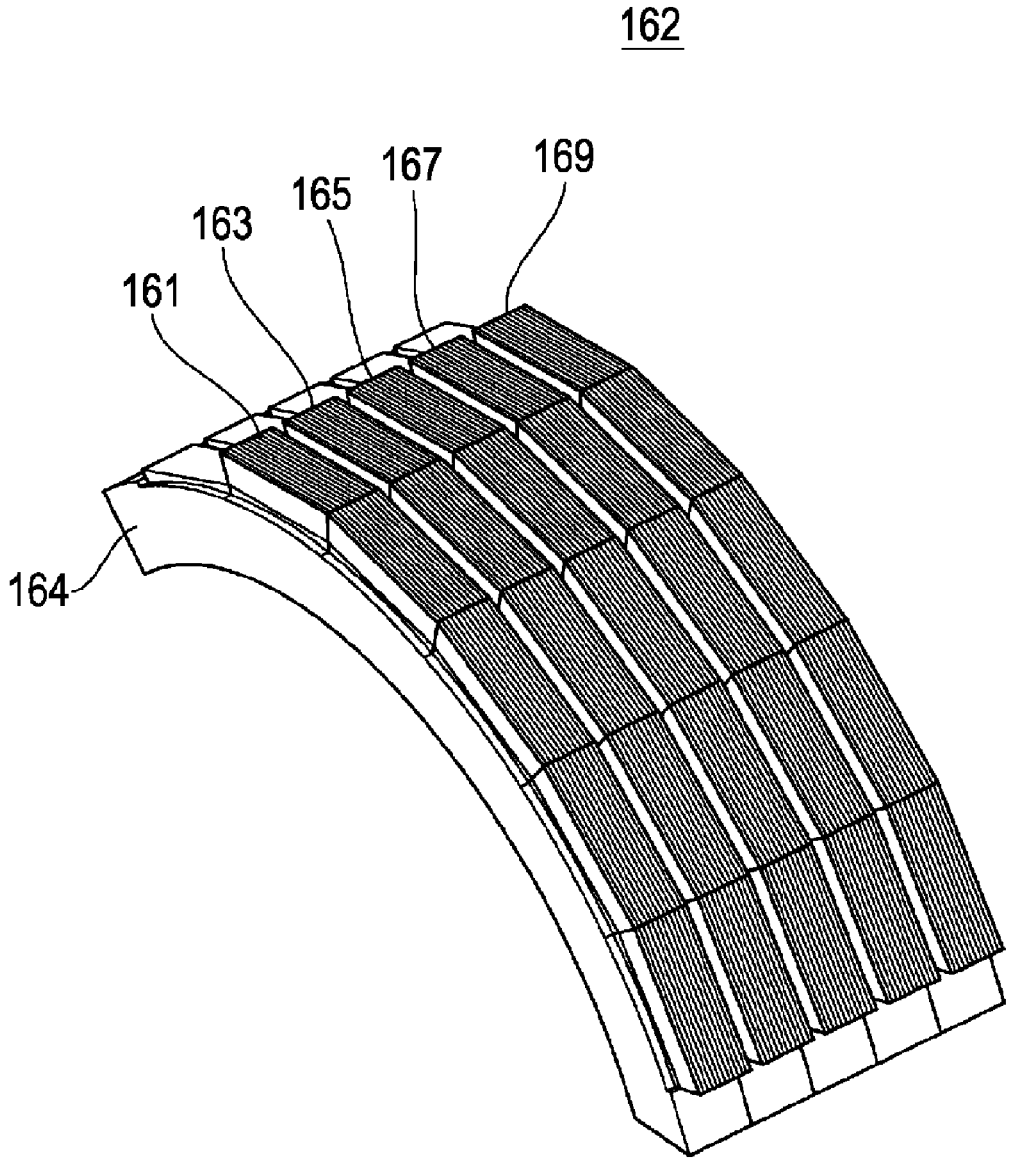
FIG. 5 is a perspective view showing only an ultraviolet ray irradiation unit 162.

FIG. 5 is a front view showing the ultraviolet ray irradiation unit 162 mounted on the irradiation unit carriage 160. As shown in FIG. 5, the ultraviolet ray irradiation unit 162 includes a plurality of lamp units 161, 163, 165, 167 and 169 mounted on a common irradiation unit frame 164. The lamp units 161, 163, 165, 167 and 169 are arranged in five rows in correspondence with the head units 181 to 185 of the recording unit 180 and the plurality of lamp units 161, 163, 165, 167 and 169 are aligned in the longitudinal direction.

The width of the irradiation range of each of the lamp units 161, 163, 165, 167 and 169 is preferably larger than the record width of each of the head units 181 to 185. Accordingly, even when the movement timings of the irradiation unit carriage 160 and the recording unit carriage 170 are different from each other, the sufficient irradiation amount of ultraviolet rays can be irradiated to the ultraviolet curing ink adhered to the recording sheet 150.

As the lamp units 161, 163, 165, 167 and 169, a metal-halide lamp, a xenon lamp, a carbon arc lamp, a chemical lamp, a low-pressure mercury lamp and a high-pressure mercury lamp may be used. In more detail, an H lamp, a D lamp and a V lamp which are manufactured by Fusion System Corporation and is commercially available may be used. Alternatively, a lamp unit may be formed using an LED for emitting light in an ultraviolet region. Since the lamp units 161, 163, 165, 167 and 169 inevitably generate heat, a cooling unit as well as a heat radiation unit is preferably provided in the lamp units 161, 163, 165, 167 and 169.

The ultraviolet curing ink which can be cured by irradiating the ultraviolet rays generated by the lamp units 161, 163, 165, 167 and 169 is made by adding auxiliary substance such as an antifoaming agent or a polymerization inhibitor to a mixture of a vehicle, a photopolymerization initiator and a pigment. The vehicle is blended by adjusting the viscosity of oligomer or monomer having a photopolymerization curing property by a reactive diluent. Accordingly, a solvent is not volatized for the purpose of curing the ink.

As the vehicle, a polyfunctional or monofunctional polymerization compound may be used. In more detail, oligomer (prepolymer) such as polyester acrylate, epoxy acrylate and urethane acrylate may be used in the vehicle and may be used in the reactive diluents for adjusting the viscosity of the ink.

As the photopolymerization initiator, benzophenone series, benzoin series, acetophenone series or thioxanthone series are widely used. In more detail, a quaternary ammonium salt-type water-soluble organic material such as 4-benzoyl-N,N,N-trimethyl benzene methaneammonium chloride, 2-hydroxy 3-(4-benzoyl-phenoxy)-N,N,N-trimethyl 1-propane ammonium chloride, 4-benzoyl-N,N-dimethyl N-[2-1-oxo-2-propenyloxy)ethyl] benzene methammonium bromide may be used. Since an ultraviolet ray absorbing property, reaction initiation efficiency and a yellowing property vary according to the composition of this type of photopolymerization initiator, the use of the photopolymerization initiator is changed in accordance with the color of the ink.

As the polymerization inhibitor, any compound which has a radical capturing capability and inhibits radical polymerization may be used. In consideration of the ejection property of the ink jet recording apparatus, a compound including at least one selected from hydroquinone series, catechol series, hindered amine series, phenol series, phenothiazine series, and quinones having a condensed aromatic ring is preferably used.

As the hydroquinone series, hydroquinone, hydroquinone monomethyl ether, 1-o-2,3,5-trimethyl hydroquinone, or 2-tert-butyl hydroquinone may be used. As the catechol series, catechol, 4-methyl catechol or 4-tert-butyl catechol may be used. As the hindered amine series, a compound having a tetramethyl-piperidinyl group may be used.

As the phenol series, phenol, butyl hydroxy toluene, butyl hydroxy anisole, pyrogallol, gallic acid or gallic acid ester may be used. As the phenothiazine series, phenothiazine may be used. As the quinones having a condensed aromatic ring, naphthoquinone may be used.

The polymerization inhibitor may be inorganic/organic particles in which a polymerization inhibition functional group is introduced into the surface or carbon black. As the polymerization inhibition functional group, for example, a hydroxyphenyl group, a dihydroxyphenyl group, a tetramethylpiperidinyl group, or a condensed aromatic ring may be used.

Figure 6:
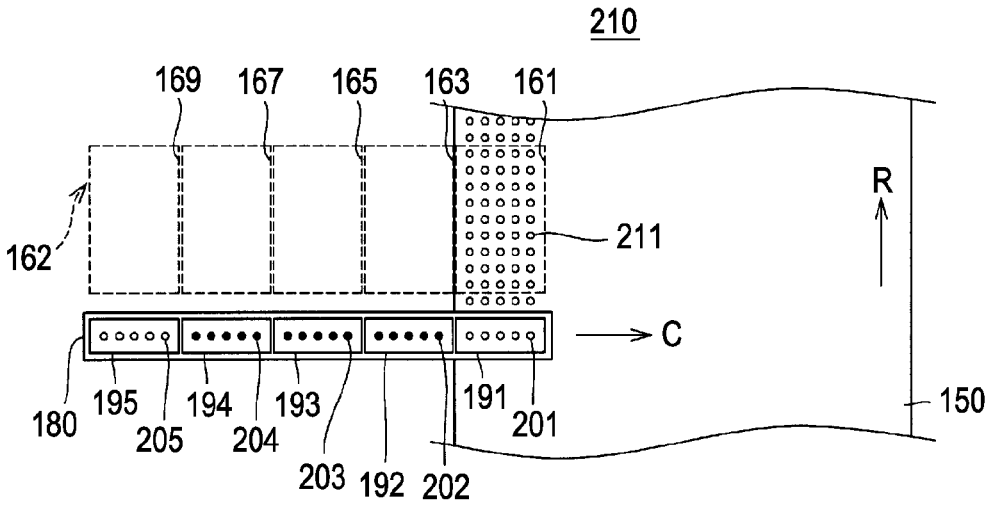
FIG. 6 is a view showing the recording head 180 and a recording pattern 210 according to the embodiment of the invention.

FIG. 6 is a view showing the structure of the recording head 180 and a recording pattern 210 formed by ink droplets 211 to 215 formed on the recording sheet 150 by the recording head 180 according to the embodiment of the invention. As shown in FIG. 6, the recording head 180 includes the five nozzle plates 191 to 195 having nozzles 201 to 205 which are arranged in a line.

The nozzle plates 191 to 195 include the plurality of nozzles 201 to 205 which are arranged in the same direction as the arrangement direction of the nozzle plates 191 to 195, respectively. In other words, the nozzles 201 to 205 are arranged in the same direction as the reciprocal movement direction of the recording unit carriage 170 guided by the guide shafts 132 and 134. In contrast, as denoted by the arrow R of the drawing, the main scan direction of the recording head 180 of the recording unit 120 is perpendicular to the reciprocal movement direction of the recording unit carriage 170 and is equal to the rotation direction of the support drum 140. Accordingly, the ultraviolet curing ink ejected from the plurality of nozzles 201 to 205 forms the droplets 211 to 215 at different positions of the recording sheet 150.

Here, among the nozzles 201 to 205 which respectively belong to the nozzle plates 191 to 195, the nozzle plates 191 and 195 provided at the both ends eject coat inks. In more detail, the nozzle plate 191 located at the front side of the movement direction of the recording unit carriage 170 denoted by an arrow C of the drawing ejects the white ink having a high hiding property. This type of white ink forms an undercoat layer.

In contrast, the nozzle plate 195 located at the back side of the movement direction of the recording unit carriage 170 ejects a transparent clear ink. The clear ink forms an overcoat layer. The three nozzle plates 192, 193 and 194 interposed between the nozzle plates 191 and 195 eject inks having different colors, for example, inks of magenta, yellow and cyan.

In the state shown in FIG. 6, first, the nozzle plate 191 ejects the white ink above the recording sheet 150 and forms the droplets 211 on the surface of the recording sheet 150. The droplets 211 are moved by the rotation of the support drum 140 to reach the ultraviolet ray irradiation unit 162. In the ultraviolet ray irradiation unit 162, the lamp unit 161 irradiates the ultraviolet rays so as to sequentially cure the droplets 211.

The wavelength and the irradiation amount of the ultraviolet rays which are most suitable for curing vary according to the composition of the ultraviolet curing ink. Since the white ink includes a large amount of pigment for the purpose of increasing the hiding property, the transmissivity of the ultraviolet rays is low. However, if the droplets 211 as the undercoat are completely cured, the adhesion property when color inks are superimposed deteriorates as described below, resulting in the stripping of the layers. Accordingly, it is preferable that the droplets 211 which form the undercoat layer are incompletely cured. Since the lamp unit 161 irradiates the ultraviolet rays to only the ink ejected from the nozzle plate 191, the ultraviolet rays can be irradiated under the condition suitable for the white ink for forming the undercoat layer.

Figure 7:
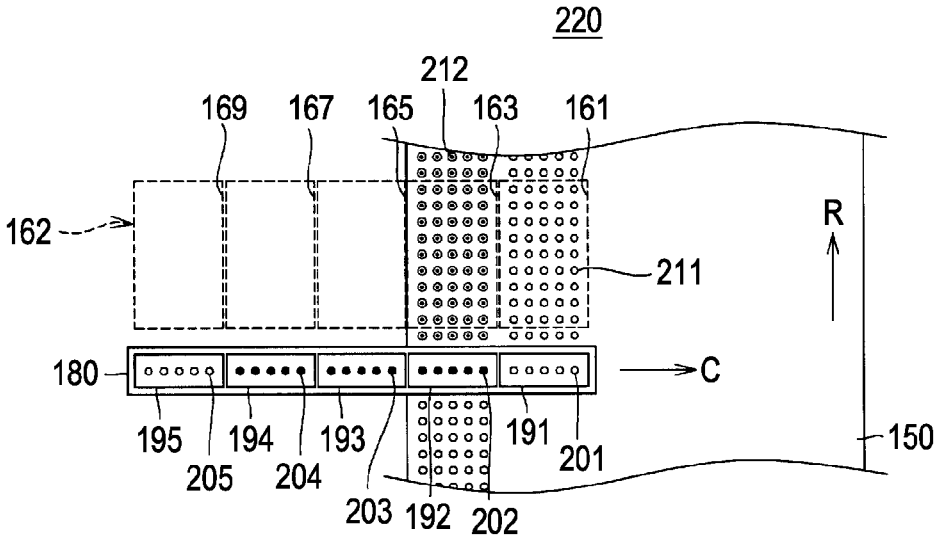
FIG. 7 is a view showing a recording pattern 220 in a state in which a support drum 140 is rotated and the recording head 180 is moved, with respect to the state shown in FIG. 6.

FIG. 7 is a view showing a recording pattern 220 in a state in which the support drum 140 is rotated one revolution and the recording head 180 is moved by the width of the nozzle plate 191. As shown in FIG. 7, the color ink ejected from the second nozzle plate 192 is superimposed on the white ink, which is already cured, so as to form droplets 212. The droplets 212 are sequentially cured by irradiating the ultraviolet rays by the lamp unit 163 provided at the downstream side of the rotation direction of the support drum 140. Accordingly, the image is formed by superimposing the color ink on the undercoat layer formed by the white ink.

The lamp units 163, 165 and 167 respectively corresponding to the nozzle plates 192 to 194 irradiate the ultraviolet rays to the droplets 212 formed on the recording sheet 150. Accordingly, the specifications of the lamp units 163, 165 and 167 are optimized in accordance with the inks having the respective colors so as to preferably cure the droplets 212.

Figure 8:
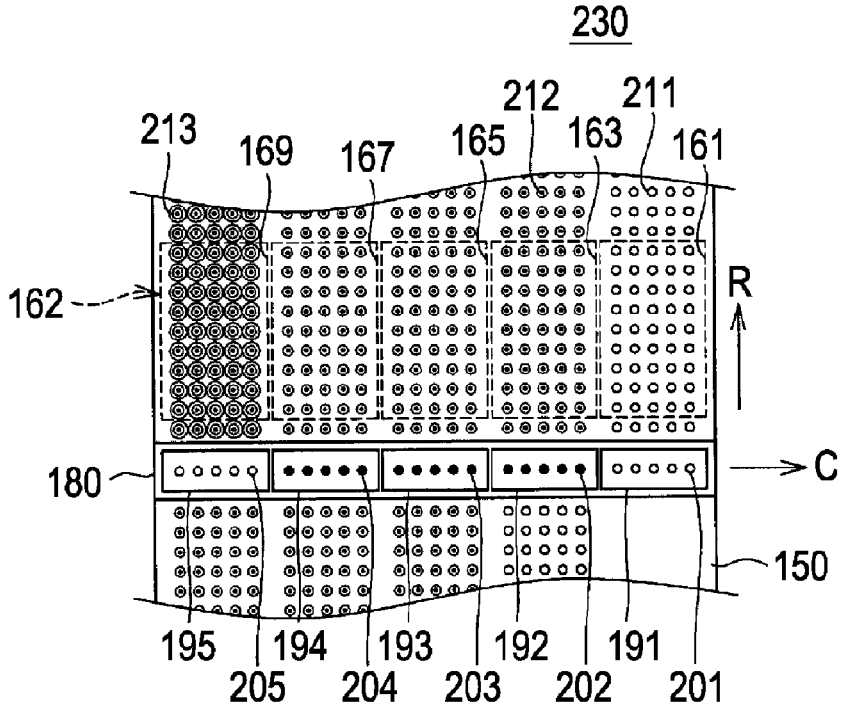
FIG. 8 is a view showing a recording pattern 230 in a state in which the support drum 140 is further rotated and the recording head 180 is further moved, with respect to the state shown in FIG. 6.

FIG. 8 is a view showing a recording pattern 230 in a state in which the support drum 140 is rotated several revolutions and the nozzle plate 195 is located above the recording sheet 150. As shown in FIG. 8, the nozzle plate 195 ejects the clear ink on the color ink droplets 212, which are already cured, so as to form the droplets 213. The droplets 213 are sequentially cured by irradiating the ultraviolet rays by the lamp unit 169. Accordingly, the image formed by the color inks is covered with the overcoat layer formed by the clear ink.

The clear ink which forms the overcoat layer does not include the pigment. Accordingly, compared with the color inks, the transmissivity of the ultraviolet rays is remarkably high. It is preferable that the surface of the overcoat layer smoothens by decreasing the curing speed. Since the lamp unit 169 is separately provided to the nozzle plate 195, the ultraviolet ray irradiation condition suitable for the clear ink can be set by decreasing the output of the ultraviolet rays.

Figure 9:
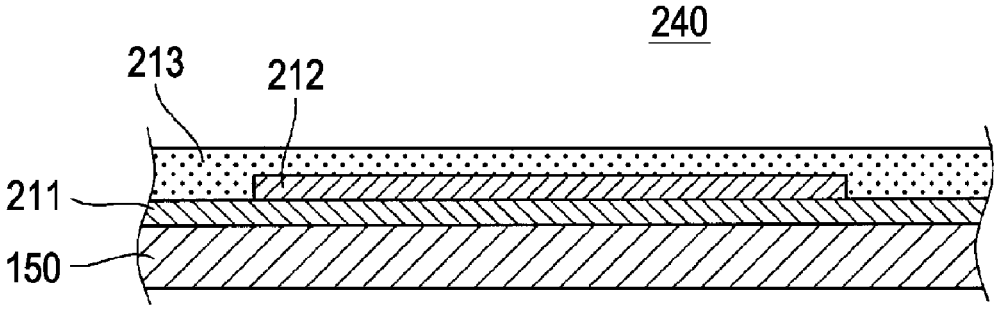
FIG. 9 is a view showing the layer structure 240 of an image formed on a recoding sheet 150 by a series of operations shown in FIGS. 6 to 8.

FIG. 9 is a view showing the layer structure 240 of an image formed on the recoding sheet 150 by a series of the above-described operations. As shown in FIG. 9, the undercoat layer formed by curing the droplets 211 is formed on the recording sheet 150. On the undercoat layer, the image formed by curing the color ink droplets 212 is laminated. The undercoat layer and the image are covered with the overcoat layer formed by curing the clear ink droplets 213. Accordingly, the color tone is not changed by the light transmitted from the rear surface of the recording sheet 150 and the protected image having the smooth surface is formed.

Figure 10:
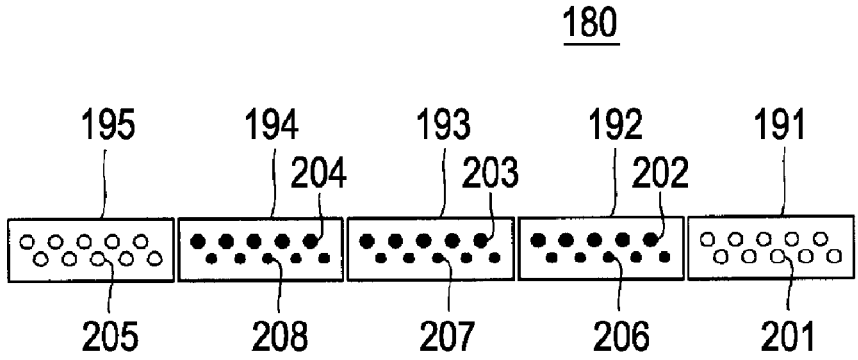
FIG. 10 is a schematic view showing the structure of the recording head 180 according to another embodiment of the invention.

FIG. 10 is a schematic view showing the shape of the recording head 180 according to another embodiment of the invention. As shown in FIG. 10, the recording head includes five nozzle plates 191 to 195. The nozzle plates 191 and 195 located at the both ends are used to eject the coat inks which form the undercoat layer and the overcoat layer, respectively.

The nozzle plates 191 to 195 include two rows of nozzles 201 to 208, respectively. Here, in the nozzle plates 191 and 195 located at the both ends, the number of nozzles 201 and 205 for ejecting the same ink is only increased.

In contrast, the nozzle plates 192, 193 and 194 include the nozzles 202 to 204 and 206 and 208 for ejecting different inks for each row. Accordingly, the type of the ink used for recording the image can be increased without increasing the number of nozzle plates 191 to 195. Accordingly, for example, an image having color gradation with high precision can be formed by a combination of cyan, light cyan, magenta, light magenta, yellow and dark yellow.

As shown in FIG. 10, two rows nozzles 202 to 204 and 206 to 208 formed in the nozzle plates 192 to 194 are deviated from each other in the sub scan direction of the recording head 180 denoted by the arrow C of the drawing. Accordingly, even when the nozzles 202 to 204 and the nozzles 206 to 208 simultaneously eject the ultraviolet curing inks in the nozzle plates 192 to 194, the droplets are formed at different places of the recording sheet 150 such that the droplets are mixed to each other in the uncured state.

Figure 11:
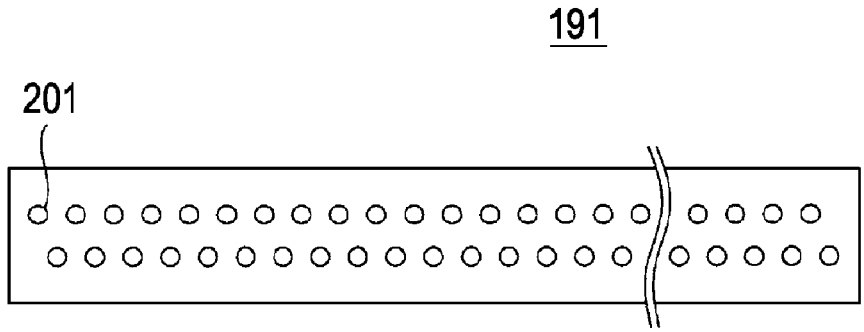
FIG. 11 is a view showing the shapes of nozzle plates 191 to 195 shown in FIG. 8.

Each of the nozzle plates 191 to 196 shown in FIGS. 6 to 9 actually includes a plurality of (several hundreds or more) of nozzles 201 as shown in FIG. 11. Although the ink jet recording apparatus 100 is described, the structure of the recording apparatus or the liquid ejecting apparatus is applicable to a color material ejecting apparatus used for manufacturing a color filter for liquid crystal display, an electrode forming apparatus used for manufacturing an organic EL display, a field emission display (FED) (surface light-emitting display) or a sample ejecting head used for manufacturing a bio chip.

Although the embodiments of the invention are described, the technical scope of the invention is not limited to the embodiments. It will be apparent to those skilled in the art that various modifications and variations can be made in the invention. Thus, it is intended that the invention covers the modifications and variations of this invention provided they come within the scope of the appended claims and their equivalents.

What is claimed is:

1. A recording apparatus comprising:

a support drum which rotates while supporting a recording medium on a support surface thereof;

a guide shaft which is spaced apart from the support surface by a predetermined distance and extends in parallel to a direction perpendicular to a rotation direction of the support drum;

a carriage which is guided by the guide shaft and is reciprocally moved along the support surface;

a recording head which is mounted on the carriage and ejects an ultraviolet curing ink toward the recording medium supported by the support surface;

a coat head which is mounted on the carriage, is provided at least one side of the recording head in a reciprocal movement direction of the carriage, and ejects an ultraviolet curing coat ink forming at least one of an undercoat layer formed on the recording medium and an overcoat layer superimposed on an ink layer adhered to a surface of the recording medium; and an ultraviolet ray irradiation unit which irradiates ultraviolet rays to the ultraviolet curing inks which are ejected from the recording head and the coat head and are adhered to the recording medium; and wherein, whenever the support drum is rotated at least one revolution, the carriage is moved along the guide shaft so as to form an image formed by the ultraviolet curing ink and the coat ink over the overall surface of the recording medium supported by the support drum.

2. The recording apparatus according to claim 1, wherein the carriage is moved in a direction in which the coat head precedes the recording head, when the undercoat layer is formed, and is moved in a direction in which the recording head precedes the coat head, when the overcoat layer is formed.

3. The recording apparatus according to claim 1, wherein, when the overcoat layer is formed, the irradiation amount of the ultraviolet rays irradiated from the ultraviolet ray irradiation unit to the coat ink is lower than that when the undercoat layer is formed.

4. The recording apparatus according to claim 1, wherein a plurality of ultraviolet ray irradiation units are arranged at the downstream side of the rotation direction of the support drum, with respect to the recording head and the coat head.

5. The recording apparatus according to claim 1, wherein the coat ink ejected from the coat head is any one of a white ink and a transparent ink.

6. A liquid ejecting apparatus comprising:

a support drum which rotates while supporting a recording medium on a support surface thereof;

a guide shaft which is spaced apart from the support surface by a predetermined distance and extends in parallel to a direction perpendicular to a rotation direction of the support drum;

a carriage which is guided by the guide shaft and is reciprocally moved along the support surface;

a liquid ejecting head which is transported by the carriage and ejects liquid including an ultraviolet curing component toward the recording medium supported by the support surface;

a coat head which is transported by the carriage, is provided at least one of a front side and a back side of the liquid ejecting head in a reciprocal movement direction of the carriage, and ejects an ultraviolet curing coat material forming at least one of an undercoat layer formed on the recording medium and an overcoat layer superimposed on an ink layer adhered to a surface of the recording medium; and an ultraviolet ray irradiation unit which irradiates ultraviolet rays to the liquid and the coat material which are ejected from the liquid ejecting head and the coat head and are adhered to the recording medium; and wherein, whenever the support drum is rotated at least one revolution, the carriage is moved along the guide shaft so as to form a pattern formed by the liquid and the coat material over the overall surface of the recording medium supported by the support drum.

* * * * *